United States Patent [19]

Esty et al.

[11] 4,032,738

[45] June 28, 1977

[54] ELECTRO-SURGICAL INSTRUMENT

[75] Inventors: Janet M. Esty, Boulder; Charles E. Taylor, Evergreen, both of Colo.

[73] Assignee: Neomed Incorporated, Boulder, Colo.

[22] Filed: May 15, 1975

[21] Appl. No.: 571,508

[52] U.S. Cl. ..... 200/157; 200/5 A; 200/159 A; 128/303.13

[51] Int. Cl.[2] ..... H01H 13/08

[58] Field of Search ..... 200/157, 86 R, 302, 200/5 A, 159 B, 292; 128/303.13, 303.14, 303.17

[56] References Cited

UNITED STATES PATENTS

| | | | |
|---|---|---|---|
| 3,246,112 | 4/1966 | Adams et al. | 200/302 |
| 3,699,294 | 10/1972 | Sudduth | 200/292 |
| 3,725,907 | 4/1973 | Boulanger | 200/5 A |
| 3,818,153 | 6/1974 | Arvai | 200/159 B |
| 3,911,241 | 10/1975 | Jarrard | 200/302 |

*Primary Examiner*—James R. Scott
*Assistant Examiner*—Morris Ginsburg
*Attorney, Agent, or Firm*—John E. Reilly

[57] ABSTRACT

A generally flat instrument provides electrical interfacing between an electro-surgical signal generator and an exposed surgical electrode. Dome-shaped momentary contact switches are sealed within the instrument housing at points convenient for manual usage. Low profile switches which resist seal degradation are employed and the device is readily adaptable for accepting replaceable chucks containing a preselected surgical electrode. The relatively narrow elongated housing imparts the feel of a non-electrical surgical instrument. Inclusion of one or more nubs or other raised portions on the switch domes facilitates identification of switch function without requiring direct observation by the user.

14 Claims, 3 Drawing Figures

ELECTRO-SURGICAL INSTRUMENT

CROSS REFERENCE TO RELATED APPLICATION

The momentary contact switches shown in the application entitled RESILIENT CONTACT SWITCH by C. E. Taylor, Ser. No. 571,516, filed concurrently herewith and assigned to the same assignee as this application, can be easily adapted for usage in the present invention.

Replaceable chucks containing a selected surgical electrode useful in conjunction with this invention are shown in the application entitled DETACHABLE CHUCK FOR ELECTROSURGICAL INSTRUMENT by J. M. Esty, Ser. No. 571,517, filed concurrently herewith and having the same assignee as this application.

The application entitled SWITCHING DEVICE FOR ELECTRO-SURGICAL INSTRUMENTS by J. W. Jarrard, Ser. No. 315,678 filed Dec. 15, 1972, now U.S. Pat. No. 3,911,241, and which is also assigned to the same assignee as this application shows an early arrangement of a potential electro-surgical instrument.

BACKGROUND OF THE INVENTION

The present invention relates to manually manipulable devices for electrically interfacing between an electro-surgical signal generator and an exposed surgical electrode. More particularly, this invention relates to surgical instruments which can be used substantially in the same manner as passive manual instruments but which include switching apparatus for permitting selection and activation of particular electro-surgical functions in association with the instrument. The present invention is especially useful by surgeons in performing electro-surgical procedures.

A wide variety of devices have been developed in the past for use by surgeons in operations. The early developments of hand tools have been supplemented by a further variety of electro-surgical apparatus. For instance, electrical pulses have been used for cauterizing and the like. Further, apparatus using high frequency or RF pulses have been employed for tissue cutting using exposed electrode elements in various configurations such as looped wires, needles, ball tips, blade-like arrangements and the like. The earlier electro-surgical devices generally required actuation via foot switches or manual switches which were inconveniently located for the surgeon or even required handling by an assistant. Such devices tend to degrade the direct control of the surgeon and thus have not always provided satisfactory results.

Accordingly, devices have been developed for the purpose of providing apparatus usable somewhat like passive surgical tool instruments but which incorporate immediately available switch apparatus so that the surgeon can directly select the electro-surgical procedure required while the instrument is in place. Devices for this purpose employing a cylindrical handle and rocker switch arrangement are shown in U.S. Pat. No. 3,801,766 by Morrison and U.S. Pat. No. 3,648,001 by Anderson, et al. However, there has been a continuing need for a surgical instrument which is adaptable for usage as a passive tool including means for selectable actuation as an electro-surgical device which has the feel of previous passive surgical instruments. Further, there has been a continuing need for such a device which can be totally sealed from the environment so that elements or materials associated with performance of a surgical procedure will not enter the instrument. Migration into the instrument by fluids associated with the operation can not only discount the effects of sterilization but can even cause malfunctioning or inadvertent functioning of the switch elements particularly if the fluid is an electrical conductor, such as blood. Still further, there has been a continuing need for such a combined passive and electro-surgical instrument which permits selection from amongst a plurality of switch functions by the surgeon without visual distraction from the procedure being performed.

SUMMARY OF THE INVENTION

This invention is a substantially flat elongated interfacing apparatus for providing the surgeon with the feel of a passive surgical tool while permitting selection and activation of electrical functions from an electro-surgical signal generator for coupling into an exposed surgical electrode. By incorporating relatively low profile momentary dome switch apparatus in the flat surface of the instrument near the end thereof to which the surgical electrode is attached, the surgeon can employ the tool passively and select and activate the electro-surgical function required with ease. By use of the deformable cap shown in the copending application cross-referenced above for a Resilient Contact Switch, the entire assembly can be sealed and the seal not degraded by actuation of the switch. A further feature of the present invention relates to the inclusion of one or more identifier nubs or symbols on the deformable switch caps so that the surgeon can identify the particular electro-surgical procedure being selected without requiring direct observation of the switch. Still further, the instrument can be adapted to include a replaceable chuck so that any of a wide variety of surgical electrodes can be employed without loss of electrical and environmental isolation of the electrical interface connection.

An object of this invention is to provide a device for interfacing between electro-surgical signal generators and a surgical electrode.

Another object of this invention is to provide a electro-surgical interfacing device which has the feel of a passive surgical tool but which permits manual selection of electro-surgical functions to be performed.

A further object of this invention is to provide an electro-surgical apparatus for providing switching and electro-surgical current conduction between an electro-surgical generator and an exposed surgical electrode through an apparatus which is totally sealed in a reliable manner from its environment.

The foregoing and other objects, features and advantages of the present invention will be more apparent in view of the following detailed descriptions of exemplary preferred embodiments.

DETAILED DESCRIPTION OF THE PREFERRED EMBODIMENTS

Figure 1:
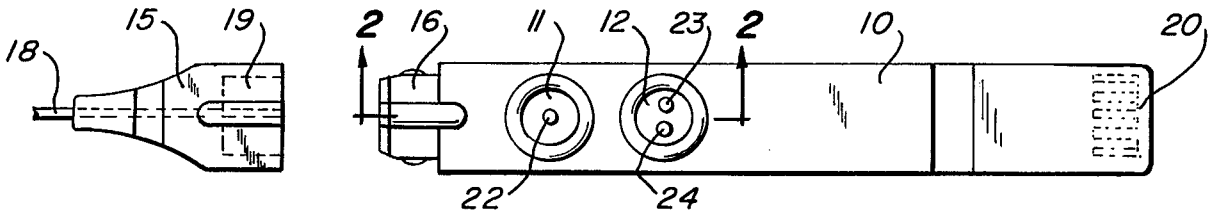
FIG. 1 is a top view of one embodiment of an electro-surgical pencil in accordance with this invention.
Figure 2:
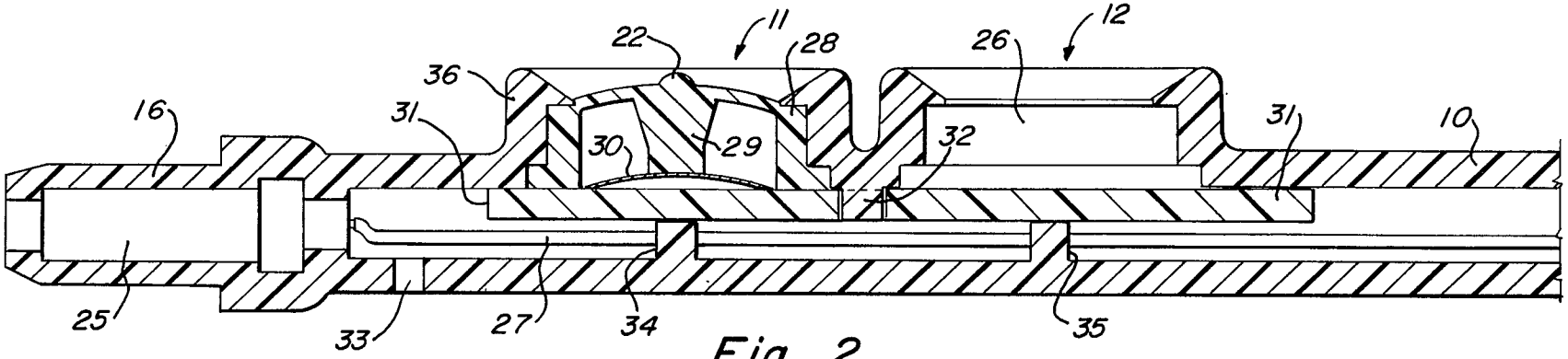
FIG. 2 is a partially sectioned side view taken along lines 2—2 of the FIG. 1 embodiment.

FIG. 1 illustrates one embodiment of an electro-surgical pencil in accordance with this invention; and FIG. 2 shows a partially sectioned side view thereof. Although both embodiments are illustrated in terms of a unipolar or single electrode electro-surgical instrument, it will be readily understood that the invention is easily adapted for other configurations. For instance, so-called bi-polar instruments which include two exposed electrodes can be easily accomodated with minimal modification or even through a common interfacing arrangement. One example of a bipolar chuck and interfacing arrangement with a handle is shown in the cross-referenced copending application entitled Detachable Chuck for Electro-Surgical Instruments by J. M. Esty.

The main housing 10 is arranged in a substantially flat elongated configuration. This housing more nearly approximates the flat handle feel of previous passive surgical instruments but still incorporates selector switches 11 and 12 near the end thereof so that the surgeon can select the desired electro-surgical procedure without movement of the instrument. At one end, replaceable chuck 15 is arranged so as to cooperate with the generally flat extension 16 from the body 10 in substantially the same manner as has been described in greater detail in the aforementioned cross-referenced application entitled Detachable Chuck For Electro-Surgical Instruments by J. M. Esty. As described in that application, chuck 15 has an exposed surgical electrode 18 which extends through the insulating body of chuck 15 so as to protrude within cavity 19. Thus the insulating shoulders of the chuck insert extension 16 on body 10 cooperates with chuck 15 so as to provide physical support as between the insulating sidewalls thereof while electrode 18 establishes a sliding contact for electrical current transmission therebetween but with this contact being substantially isolated from the environment of the surgery being performed. Although electrode 18 has been shown without the portion thereof which provides the passive and/or electro-surgical function such as a scalpel blade, wire loop or the like, it will be readily understood that any of these devices can be incorporated for the exposed portion of the electrode 18.

The broad general function performed by frame 10 with chuck 15 attached is to permit momentary switch actuations via switches 11 and 12 which are transmitted through a cable attached to socket 20 and then to an electro-surgical generator. The actuation of either of switches 11 or 12 in a typical application results in selection of a generally continuous high frequency signal as when switch 11 is actuated or a series of short RF pulses as when switch 12 is actuated. Whichever of these signals has been selected is returned from the signal generator through the cable (not shown) into socket 20 and thence through the housing 10 and into electrode 18 of chuck 15. In the particular example illustrated, selection of switch 11 produces a high frequency pulse for procedures such as tissue cutting with a wire loop at electrode 18 whereas selection of switch 12 effects a pulse selection into electrode 18 to provide cauterizing or coagulating functions.

Many surgical procedures require precise locating of the exposed tool element attached to electrode 18 and the maintenance of this position while the electro-surgical function desired is selected. A nub or protrusion 22 is shown in this example as being included in the upper surface of dome switch 11 and a pair of nubs or protrusions 23 and 24 are included on the upper surface of dome switch 12 so that the surgeon can identify the function to be performed by actuation of that switch simply by feel. Thus the attention of the surgeon need not be diverted from the operation being performed in association with the electrode 18. Note that a variety of other arrangements for identification by feel can be used. For example, a single nub can be incorporated on one switch and none on the other, single nubs can be used on both, other shapes or symbols or even words can be used if desired. Further, the identifying protrusion need not be placed directly on the dome but it is preferable to place it there so that the surgeon can tell what switch is about to be actuated.

FIG. 2 shows a section side view of the elements contained within housing 10. More particularly, electrical connector 25 is embedded in the chuck insert extension 16 of housing 10 and attached to conductor 27 which extends through the length of housing 10 to a terminal in the socket 20 (not shown in FIG. 2). Connector 25 suitably may be a spring-biased female connector which will permit sliding contact with electrode 18 when chuck 15 is placed over extension 16 and locked into place. The dome switches 11 and 12 illustrated in FIGS. 1 and 2 are preferably similar to those described in detail in the copending application entitled Resilient Contact Switch by C. E. Taylor. As described in that application, cylindrical sidewalls 28 are bonded to and/or compressively retained within the retaining frame of housing 10. The upwardly arcuate configuration of these flexible devices permits downward movement of plunger 29 so as to momentarily deform deflectable metal dome 30 thus completing a switch function in association with electrical contact points on circuit board 31. The contact points, although not shown, may correspond to the electrical outlet points 61, 62 and 63, 64 shown in FIG. 3, and are connected by conductors running through the length of housing 10 into appropriate contacts at socket 20. A similar arrangement is incorporated for switch 12 which has contacts on underlying circuit board 31, these contacts being likewise independently connected to a conductor in socket 20. Note that the cap and dome for switch 12 (which would be similar to switch 11) are not shown in FIG. 2 to more clearly illustrate the retaining collar arrangement of bore 26 in housing 10. It should be noted that one common connector from socket 20 can be included with connections to peripheral lands under both switches 11 and 12 and a separate connector for each being located under the domes 11 and 12. The center connection would be typically interconnected to plug 20 via passage through board 31 and conductors on the lower side thereof. Thus only four conductors at socket 20 are needed to provide all necessary operations.

Note that circuit board 31 is retained in place by stub 32 which extends downward from the upper portion of housing 10 into a mating hole in board 31. The lower portion of housing 10 has a series of transverse ribs such as 34 and 35 spaced along its length to provide upward pressure on the lower surface of board 31 to hold it in proper position relative to switches 11 and 12. By fabricating the flexible dome caps and plungers for switches 11 and 12 of a flexible material such as silicone rubber and further by making cylindrical sidewalls such as 28 of slightly greater length than the inner bore of retaining rings therefor on housing 10 (i.e.: shouldered ring 36), the compression of the flexible dome caps into the radially shouldered retaining bores will effect a seal therebetween by upward pressure from the upper surface of board 31. Furthermore, by using the crosssection shown in FIG. 2 as is described in detail in the cross-referenced copending application for a Resilient Contact Switch by C. E. Taylor, the compression seal between retaining ring 36 and cap sidewall 28 will not be compromised by axial depression of the caps.

In assembly, housing 10 typically is fabricated from two matching components of electrically insulating plastic material which is compatible with high temperature sterilization. For instance, polycarbonate Merlin M-50, Lexan 2014 polysulfone (Union Carbide) or equivalent can be used. These materials can be ultrasonically bonded at the seams therebetween thus completing the encasing of housing 10. The inclusion of surface bonds on each shell of the housing somewhat like that described in the copending application entitled Detachable Chuck for Electro-Surgical Instruments by J. M. Esty will facilitate such ultrasonic welding. Further, access ports such as 33 can be included to permit injection of further sealant material such as silicone rubber at each end to insure sealed environmental isolation for the interior of housing 10.

Figure 3:
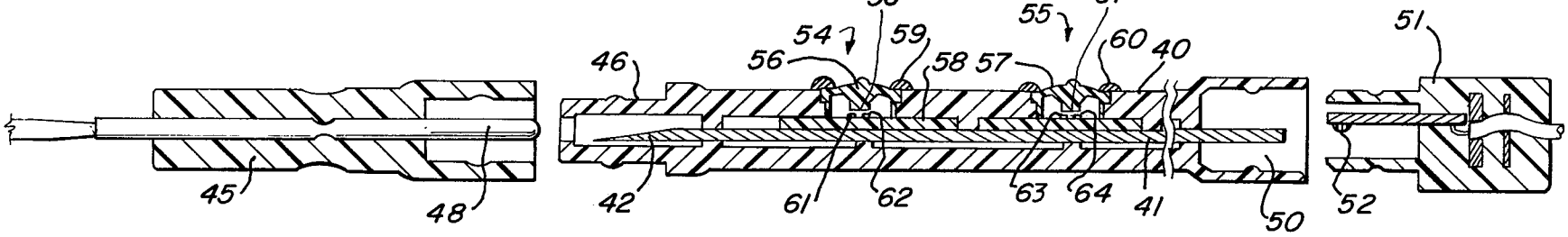
FIG. 3 is a partially sectioned side view of another potential embodiment of the present invention.

The embodiment shown in FIG. 3 is particularly well suited for fabrication using low cost elements and techniques. More particularly, the main housing 40 is arranged so that a printed circuit board 41 extends throughout the length thereof with one tip 42 being flexibly retained at the extreme end thereof. Thus, insertion of replaceable chuck 45 onto the extension 46 will result in electrode 48 forcing downwardly on the upper clad surface of tip 42 thereby establishing a sliding electrical contact. This electrical contact is carried through board 41 into socket 50 which mates with plug 51 so that the downward projections such as 52 establish electrical contact at the other end with contacts 61, 62, 63, and 64. Further, switches 54 and 55 can be of the low profile deflectable configuration composed of flexible electrically conductive materials described in the co-pending Resilient Contact Switch application by C. E. Taylor.

More particularly, the domes 56 and 57 for switches 54 and 55, respectively, can be made of a deformable conductive material or non-conductive flexible material with conductive surfaces 56′ and 57′ associated with the lower ends of the coaxial plungers. Thus downward pressure of either of these switches will effect a switch function with respect to contact points on circuit board 58 and thus provide a signal through interconnections on board 41 into plug 51 and thence the electro-surgical generator. These switch domes are arranged for insertion into housing 40 and retained in place by collars 59 and 60 with this entire assembly thereafter being sonically welded. As with the FIG. 1 embodiment, nubs can be included on the upper surfaces of domes 56 and 57 to assist in function identification by feeling.

Plug 51 is preferably a molded silicone strain relief arrangement. The interior of housing 40 can be filled with silicone material or the like to increase stiffness and the entire apparatus can be fabricated from polypropylene molding procedures. It should be further noted that the chuck 45 and the extending electrode 48 can actually be molded as part of housing 40 rather than as a replaceable chuck. Under such circumstances, the entire housing 40 including its electrode can be employed as a low usage, low cost, throw-away apparatus. Further, the interior end of electrode 48 can be beveled so as to further increase sliding contact against the flexing tip 42 of board 41.

Although the present invention has been described with particularity with respect to the detailed description of the foregoing exemplary preferred embodiments, various modifications, changes, applications and additions will be readily apparent to those having normal skill in the art without departing from the spirit of the invention.

What is claimed is:

1. Apparatus for providing an interface between an electro-surgical electrode and an electro-surgical generator which apparatus is manually manipulable as a surgical instrument comprising:

an electrically insulating housing having generally rectangular cross-section formed by a pair of elongated substantially flat rigid surfaces between a pair of sidewalls with narrow cross-sectional dimensions relative to said flat rigid surfaces, one of said flat rigid surfaces having at least one bore extending therethrough in proximity to one end of said housing and each said bore being outwardly encircled by an upright cylindrical wall terminating in inwardly turned shoulders, means at one end of said housing for receiving a shank of an electro-surgical electrode, at least one pair of electrical contact points arranged internally to said housing in underlying relation to said bore, a momentary switch assembly including a hollow peripheral sidewall, a flexible cap enclosing one end of said peripheral sidewall and electrical circuit completing means, said peripheral sidewall being retained in sealing engagement internal to said housing bore and said upright cylindrical wall, said cap having a cross-section which is outwardly arcuate relative to the exterior of said housing for permitting inward coaxial movement thereof without imparting inward collapsing forces to said peripheral sidewall, said electrical circuit completing means being responsive to movement of said cap in inward coaxial relation to said peripheral wall for completing electrical contact between said pair of electrical contact points, said flexible cap having sufficient material memory for withdrawing said electrical circuit completing means from said pair of electrical contact points in the absence of application of an inward axial force thereto, and means extending longitudinally through said housing from the other end thereof for coupling the electro-surgical generator with said shank receiving means and said pair of electrical contact points for establishing operational electrical communication therebetween, whereby said housing is manually usable with the feel of a passive surgical instrument while permitting manual selection of electro-surgical functions.

2. Apparatus in accordance with claim 1 wherein said housing has a plurality of bores arranged along one of said flat rigid surfaces in proximity to said one end of said housing, said apparatus further including a plurality of momentary switch assemblies each mounted within a respective said bore so as to be manually actuable from said one of said flat rigid surfaces, a plurality of said pairs of electrical contact points each arranged within said housing under respective said bores, said coupling means connecting said contact points to the electro-surgical generator for effecting selectable control of different electro-surgical operations by the electro-surgical electrode.

3. Apparatus in accordance with claim 2 wherein at least one of said momentary switch assemblies has indexing means whereby the electro-surgical function being selected by actuation of the associated said switch assembly can be determined by manual touch sensitivity.

4. Apparatus in accordance with claim 2 wherein each of said electrical circuit completing means includes an arcuate deflectable conductive dome having one of the associated contact points connected to the peripheral edge thereof and the other of said contact points positioned in normally spaced relation under the central portion of said dome, said dome being arranged to extend into the hollow interior of said peripheral wall in the absence of inward deflection of said flexible cap.

5. Apparatus in accordance with claim 4 wherein each said momentary switch assembly includes a plunger attached to the central portion of said flexible cap extending coaxially into said peripheral wall into proximity with the central portion of the associated said dome.

6. An apparatus in accordance with claim 2 wherein each said cap and each said peripheral sidewall of each said switch assembly is of flexible electrically conductive material, each said switch assembly further including a plunger element extending from the central portion of said cap coaxially into said hollow peripheral wall, each of said bores having the sidewall of a respective said cap in abutting engagement therewith so that said cap is at the external end thereof, and further being positioned so that a respective one of said pairs of electrical contact points is at the internal end thereof, one contact point being electrically connected to said plunger element with the other contact point of said pair being positioned under said plunger element in normally spaced relation to the line of travel thereof, whereby electrical communication is established between the said contact points through said cap in response to movement of said cap plunger element without degrading interior isolation of said housing.

7. Apparatus in accordance with claim 1 for use with an electrically insulating chuck which has the electro-surgical electrode sealably retained for passage therethrough so that the shank thereof protrudes into a cavity extending into the chuck from one side with the electro-surgical element of the electrode extending from the other side, said housing of said apparatus including a probe portion at the said one end thereof with said probe portion being dimensioned for coaxially engaging the chuck cavity whereby an electrical interface connection between said shank receiving means and the electrode shank is substantially isolated from the environment of the electro-surgical instrument.

8. Apparatus for providing an interface between an electro-surgical signal generator and an electro-surgical electrode which apparatus is manually manipulable as a surgical instrument comprising:

an elongated hollow casing of a rigid electrically insulating material which is relatively inert to sterilization temperatures in a narrow substantially rectangular cross-section, said casing having a plurality of openings along one of the flat rigid surfaces thereof with said openings being arranged serially from proximity to a first end of said casing with each of said openings having a surrounding radially inwardly extending collar, a printed circuit board retained within said casing and having a plurality of pairs of contact points arranged beneath the interior area of respective said openings and having a plurality of conductors connecting said contact points to a terminal area at the second end of said casing, a plurality of momentary contact means arranged in respective said openings for establishing electrical communication between said contact points beneath the associated opening, said momentary contact means each including a flexible cap having cylindrical sidewalls retained in sealed abutting engagement within the collar of each associated opening and having a closure across each end of said sidewalls opposite said contact points, said closure having an externally arcuate cross-section and having a plunger attached thereto extending axially within said sidewalls towards said contact points, means for receiving an electro-surgical electrode at said first end of said casing, means for electrically coupling an attaching means to said terminal area, and means for interconnecting said terminal area with an electro-surgical generator, whereby said casing can be manually utilized in the manner of a passive surgical instrument with axially inward pressure on a selected one of the closures thereby effecting electrical communication through the associated said contact points which causes the electro-surgical generator to return an appropriate signal to the electro-surgical electrode.

9. Apparatus in accordance with claim 8 which further includes a plurality of electrically conductive domes positioned between the inner end of each respective said plunger and the said pair of contact points associated therewith, the peripheral edge of each of said electrically conductive domes being electrically connected to one of said contact points of the associated pair and the other associated contact point being positioned in normally spaced relation under said dome but in line with the axial travel of the central portion of said dome so as to establish electrical communication with the said contact point of said pair in response to inward movement of the associated said plunger.

10. Apparatus in accordance with claim 9 wherein at least one of said closures of said caps has indexing means thereon whereby the electro-surgical operation selected by actuation of said caps can be identified by touch or direct observation.

11. Apparatus in accordance with claim 8 wherein the flexible caps are composed of a resilient electrically conductive material with one of said contact points of the associated pair being electrically connected to the sidewall thereof and the other associated contact point being positioned in normally spaced relation but in the axial line of travel of the associated said plunger.

12. Apparatus in accordance with claim 11 wherein at least one of said caps has indexing means thereon whereby the electro-surgical operations selected by actuation of said caps can be determined by touch or direct observation.

13. Apparatus in accordance with claim 8 wherein the flexible caps are each composed of a resilient electrically insulating material with an electrically conductive surface on the end of said plunger thereof opposite said closure, at least one pair of said contact points being positioned relative to said plunger for having electrical communication established therebetween in response to coaxial movement of said plunger.

14. Apparatus in accordance with claim 8 wherein said casing has a probe extending from said first end with said probe being of reduced dimensions but the same general rectangular cross-section as said casing, said electrode receiving means being of elongated configuration axially aligned with a port through the outer end of said probe, a housing of electrically insulating material retaining the electro-surgical electrode in sealed relation therethrough so that one end thereof protrudes within a cavity extending into one side of said housing with said housing cavity being dimensioned to fit over said probe and said electrode end being aligned for entering said port and slidingly engaging said receiving means, whereby attachment of said housing to said probe effects environmental isolation of the juncture between said one end of said electrode and said receiving means.

* * * * *

UNITED STATES PATENT OFFICE

CERTIFICATE OF CORRECTION

Patent No. 4,032,738 Dated 28 June 1977

Inventor(s) Janet M. Esty; Charles E. Taylor

It is certified that error appears in the above-identified patent and that said Letters Patent are hereby corrected as shown below:

Claim 11, Column 8, line 62, after "the" (2nd occurrence) add -- said --.

Claim 14, Column 10, line 9, after "said" (2nd occurrence) add -- elongated --.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*